US007521622B1

(12) United States Patent
Zhang

(10) Patent No.: US 7,521,622 B1
(45) Date of Patent: Apr. 21, 2009

(54) NOISE-RESISTANT DETECTION OF HARMONIC SEGMENTS OF AUDIO SIGNALS

(75) Inventor: Tong Zhang, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 32 days.

(21) Appl. No.: 11/676,174

(22) Filed: Feb. 16, 2007

(51) Int. Cl.
*A63H 5/00* (2006.01)
*G04B 13/00* (2006.01)
*G10H 7/00* (2006.01)

(52) U.S. Cl. ..... 84/609; 84/603; 84/613; 84/616

(58) Field of Classification Search ..... None
See application file for complete search history.

(56) References Cited

U.S. PATENT DOCUMENTS

| | | | | |
|---|---|---|---|---|
| 5,986,199 | A * | 11/1999 | Peevers | 84/603 |
| 6,173,260 | B1 | 1/2001 | Slaney | |
| 6,542,869 | B1 * | 4/2003 | Foote | 704/500 |
| 7,130,795 | B2 | 10/2006 | Gao | |
| 7,155,386 | B2 | 12/2006 | Gao | |
| 2001/0023396 | A1 * | 9/2001 | Gersho et al. | 704/220 |
| 2002/0161576 | A1 | 10/2002 | Benyassine et al. | |
| 2005/0217462 | A1 * | 10/2005 | Thomson et al. | 84/612 |
| 2006/0064301 | A1 * | 3/2006 | Aguilar et al. | 704/233 |
| 2006/0089833 | A1 * | 4/2006 | Su et al. | 704/230 |
| 2007/0106503 | A1 * | 5/2007 | Kim | 704/211 |
| 2007/0239437 | A1 * | 10/2007 | Kim | 704/207 |
| 2008/0046241 | A1 * | 2/2008 | Osburn et al. | 704/250 |

OTHER PUBLICATIONS

Y. D. Cho, M. Y. Kim and S. R. Kim, A spectrally mixed excitation (SMX) vocoder with robust parameter determination, Proc. ICASSP'98, pp. 601-604, 1998.

W. Chou and L. Gi, "Robust singing detection in speech/music discriminator design," Proc. ICASSP, Salt Lake (May 2001).

* cited by examiner

*Primary Examiner*—Marlon T Fletcher

(57) ABSTRACT

Respective pitch values are estimated for an audio signal. Candidate harmonic segments of the audio signal are identified from the estimated pitch values. Respective levels of harmonic content in the candidate harmonic segments are determined. An associated classification record is generated for each of the candidate harmonic segments based on a harmonic content predicate defining at least one condition on the harmonic content levels. An associated classification record also may be generated for each of the audio signal segments classified into a harmonic segment class based on a classification predicate defining at least one condition on the estimated pitch values. The classification records that are associated with ones of the harmonic segments satisfying the classification predicate include an assignment to a speech segment class. The classification records that are associated with ones of the harmonic segments failing to satisfy the classification predicate include an assignment to a music segment class.

20 Claims, 9 Drawing Sheets audio_file = audio_1 ← 32

| 34 Seg_ID | 36 Seg_Location | 38 Classification Record |
|---|---|---|
| a_seg_1: | 1_start, 1_end | 1_class=non-harmonic |
| a_seg_2: | 2_start, 2_end | 2_class=harmonic |
| ⋮ | ⋮ | ⋮ |
| a_seg_C: | C_start, C_end | C_class=non-harmonic |

30

FIG. 3

NOISE-RESISTANT DETECTION OF HARMONIC SEGMENTS OF AUDIO SIGNALS

BACKGROUND

Detecting speech and music in audio signals (e.g., audio recordings and audio tracks in video recordings) is important for audio and video indexing and editing, as well as many other applications. For example, distinguishing speech signals from ambient noise is a critical function in speech coding systems (e.g., vocoders), speaker identification and verification systems, and hearing aid technologies. While there are existing approaches for distinguishing speech or music from silence or other environmental sound, the performance of these approaches drops dramatically when speech signals or music signals are mixed with noise, or when speech signals and music signals are mixed together. Thus, what are needed are systems and methods that are capable of noise-resistant detection of speech and music in audio signals.

SUMMARY

In one aspect, the invention features a method in accordance with which respective pitch values are estimated for an audio signal. Candidate harmonic segments of the audio signal are identified from the estimated pitch values. Respective levels of harmonic content in the candidate harmonic segments are determined. An associated classification record is generated for each of the candidate harmonic segments based on a harmonic content predicate defining at least one condition on the harmonic content levels.

In another aspect, the invention features a system that includes an audio parameter data processing component and a classification data processing component. The audio parameter data processing component is operable to estimate respective pitch values for an audio signal and to determine respective levels of harmonic content in the audio signal. The classification data processing component is operable to identify candidate harmonic segments of the audio signal from the estimated pitch values and to generate an associated classification record for each of the candidate harmonic segments based on a harmonic content predicate defining at least one condition on the harmonic content levels.

In another aspect, the invention features a method in accordance with which respective pitch values are estimated for an audio signal. Harmonic segments of the audio signal are identified from the estimated pitch values. An associated classification record is generated for each of the harmonic segments based on a classification predicate defining at least one condition on the estimated pitch values. The classification records that are associated with ones of the harmonic segments satisfying the classification predicate include an assignment to a speech segment class. The classification records that are associated with ones of the harmonic segments failing to satisfy the classification predicate include an assignment to a music segment class.

Other features and advantages of the invention will become apparent from the following description, including the drawings and the claims.

DESCRIPTION OF DRAWINGS

FIG. 3 is a diagrammatic view of an embodiment of a classification output that is produced by an embodiment of the audio processing system shown in FIG. 1.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

I. INTRODUCTION

The embodiments that are described in detail below are capable of noise-resistant detection of speech and music in audio signals. These embodiments employ a two-stage approach for distinguishing speech and music from background noise. In the first stage, candidate harmonic segments, which are likely to contain speech, music, or a combination of speech and music, are identified based on an analysis of pitch values that are estimated for an audio signal. In the second stage, the candidate harmonic segments are classified based on an analysis of the levels of harmonic content in the candidate harmonic segments. Some embodiments classify the candidate harmonic segments into one of a harmonic segment class and a noise class. Some embodiments additionally classify the audio segments that are classified into the harmonic segment class into one of a speech segment class and a music segment class based on an analysis of the pitch values estimated for these segments.

II. OVERVIEW

Figure 1:
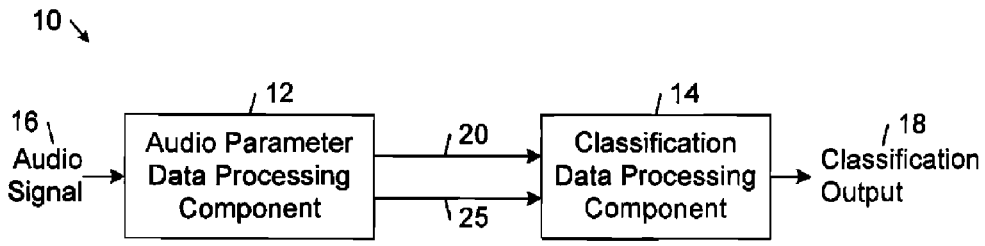
FIG. 1 is a block diagram of an embodiment of an audio processing system.

FIG. 1 shows an embodiment of an audio processing system 10 that includes an audio parameter data processing component 12 and a classification data processing component 14. In operation, the audio processing system 10 processes an audio signal 16 to produce a classification output 18 that includes one or more classification records that assign classification labels to respective segments of the audio signal 16.

In general, the audio signal 16 may correspond to any type of audio signal, including an original audio signal (e.g., an amateur-produced audio signal, a commercially-produced audio signal, an audio signal recorded from a television, cable, or satellite audio or video broadcast, or an audio track of a recorded video) and a processed version of an original audio signal (e.g., a compressed version of an original audio signal, a sub-sampled version of an original audio signal, or an edited version of an original audio signal). The audio signal 16 typically is a digital signal that is created by sampling an analog audio signal. The digital audio signal typically is stored as a file or track on a machine-readable medium (e.g., nonvolatile memory, volatile memory, magnetic tape media, or other machine-readable data storage media).

Figure 2:
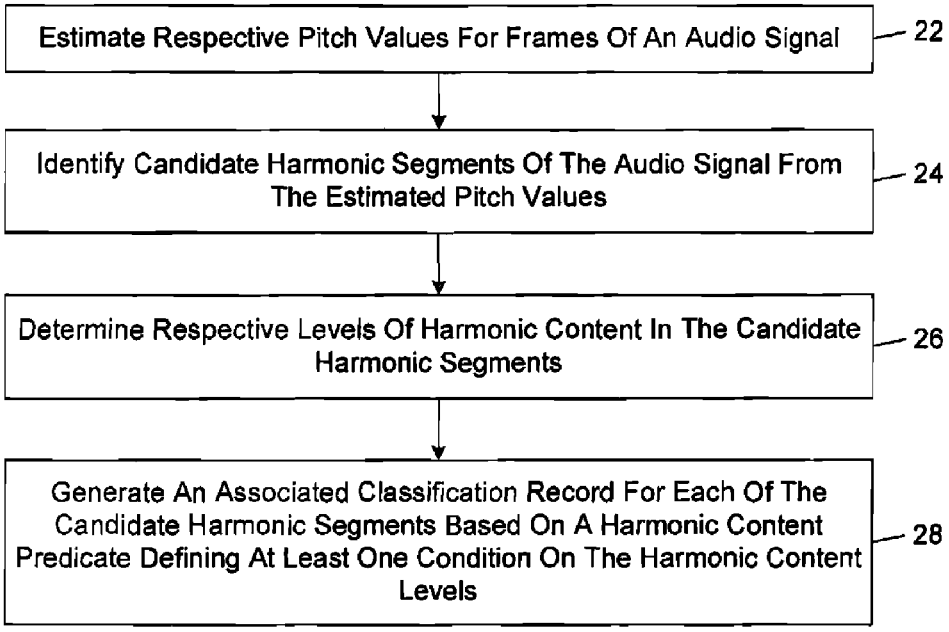
FIG. 2 is a flow diagram of an embodiment of an audio processing method.

FIG. 2 shows an embodiment of a method that is implemented by the audio processing system 10.

The audio parameter data processing component 12 estimates respective pitch values 20 for the audio signal 16 (FIG. 2, block 22). In general, the audio parameter data processing component 12 may estimate the pitch values 20 in any of a wide variety of different ways, including autocorrelation based methods, cepstrum based methods, filter based methods, neural network based methods, etc.

The classification data processing component 14 identifies candidate harmonic segments of the audio signal 16 from the estimated pitch values (FIG. 2, block 24). In some embodiments, the classification data processing component 14 identifies the candidate harmonic segments by identifying segments of the audio signal 16 having slowly changing pitch amplitudes over a minimal duration. In general, the classification data processing component 14 may identify such segments of the audio signal 16 in any of a wide variety of different ways, including first degree difference based methods and threshold based methods.

The audio parameter data processing component 12 determines respective levels 25 of harmonic content in the candidate harmonic segments (FIG. 2, block 26). In general, the audio parameter data processing component 12 may model the harmonic content in the audio signal 16 in any of a wide variety of different ways, including filter based methods, neural network based methods, and threshold based methods.

The classification data processing component 14 generates an associated classification record for each of the candidate harmonic segments based on a harmonic content predicate defining at least one condition on the harmonic content levels (FIG. 2, block 28). The harmonic content predicate typically maps the candidate harmonic segments having relatively high levels of harmonic content to a harmonic segment class and maps other candidate harmonic segments having relatively low levels of harmonic content to a non-harmonic segment class.

The order in which the process blocks 22-28 are presented in FIG. 2 does not imply any particular ordering of the processes that are performed by the audio processing system 10 in implementing the method of FIG. 2. Although some implementations of the audio processing system 10 may perform the processes in the order shown in FIG. 2, other embodiments may perform these processes in a different order. For example, in some embodiments, the audio parameter data processing component 12 may estimate the pitch values (FIG. 2, block 22) and determine the harmonic content levels (FIG. 2, block 26) before the classification data processing component 14 identifies candidate harmonic segments (FIG. 2, block 24) and generates the associated classification records (FIG. 2, block 28).

In the embodiment shown in FIG. 1, the audio processing system 10 typically generates the classification output 18 in the form of data that identifies the segments of the audio signal 16 that are segmented into the harmonic segment class. These segments typically are identified by respective start and end indices (or pointers) that demarcate the sections of the audio signal 16 that are classified into the harmonic segment class.

FIG. 3 shows an embodiment 30 of the classification output 18 that corresponds to a data structure in the form of a text file that complies with an audio segment classification specification. The classification output 30 identifies C segments of the audio signal 16 and the associated classification records that are generated by the audio processing system 10. The classification output 30 contains an audio_file field 32, a Seg_ID field 34, a Seg_Location field 36, and a Classification_Record field 38. The audio_file field 32 identifies the audio signal 16 (i.e., audio_1). The Seg_ID field 34 identifies the classified segments of the audio signal (i.e., a_seg_i for all i=1, 2, . . . , C, where C has a positive integer value). In some embodiments, the audio segments correspond to contiguous non-overlapping sections of the audio signal 16 that collectively represent the audio signal 16 in its entirety. The Seg_Location field 36 specifies the start position (i.e., i_start, for all i=1, . . . , C) and the end position (i.e., i_end, for all i=1, . . . , C) of each of the audio signal segments identified in the classification output 30. The Classification_Record field 38 labels each of the audio segments with an associated class label (e.g., non-harmonic or harmonic).

The classification output 30 may be embodied in a wide variety of different forms. For example, in some embodiments, the classification output 30 is stored on a machine (e.g., computer) readable medium (e.g., a non-volatile memory or a volatile memory). In other embodiments, the classification output 30 is rendered on a display. In other embodiments, the classification output 30 is embodied in an encoded signal that is streamed over a wired or wireless network connection.

The classification output 30 may be processed by a downstream data processing component that processes a portion or the entire audio signal 16 based on the classification records associated with the identified audio segments.

III. EXEMPLARY EMBODIMENTS OF THE AUDIO PROCESSING SYSTEM AND ITS COMPONENTS

A. An Exemplary Audio Processing System Architecture

The audio processing system 10 typically is implemented by one or more discrete data processing components (or modules) that are not limited to any particular hardware, firmware, or software configuration. For example, in some implementations, the audio data processing system 10 is embedded in the hardware of any one of a wide variety of electronic devices, including desktop and workstation computers, audio and video recording and playback devices (e.g., VCRs and DVRs), cable or satellite set-top boxes capable of decoding and playing paid video programming, portable radio and satellite broadcast receivers, and portable telecommunications devices. The data processing components 12 and 14 may be implemented in any computing or data processing environment, including in digital electronic circuitry (e.g., an application-specific integrated circuit, such as a digital signal processor (DSP)) or in computer hardware, firmware, device driver, or software. In some embodiments, the functionalities of the data processing components 12 and 14 are combined into a single processing component. In some embodiments, the respective functionalities of each of one or more of the data processing components 12 and 14 are performed by a respective set of multiple data processing components.

In some implementations, process instructions (e.g., machine-readable code, such as computer software) for implementing the methods that are executed by the audio processing system 10, as well as the data it generates, are stored in one or more machine-readable media. Storage devices suitable for tangibly embodying these instructions and data include all forms of non-volatile computer-readable memory, including, for example, semiconductor memory devices, such as EPROM, EEPROM, and flash memory devices, magnetic disks such as internal hard disks and removable hard disks, magneto-optical disks, DVD-ROM/RAM, and CD-ROM/RAM.

Figure 4:
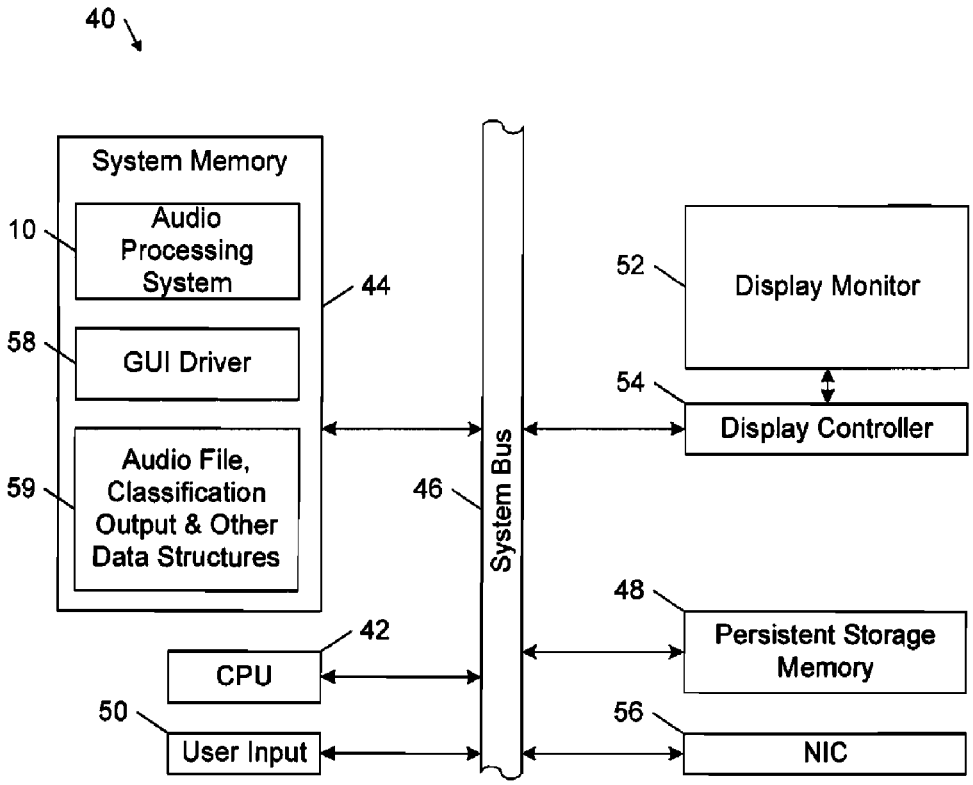
FIG. 4 is a block diagram of an embodiment of a computer system that is programmable to implement an embodiment of the audio processing system shown in FIG. 1.

FIG. 4 shows an embodiment of the audio processing system 10 that is implemented by one or more software modules operating on an embodiment of a computer 40. The computer 40 includes a processing unit 42 (CPU), a system memory 44, and a system bus 46 that couples processing unit 42 to the various components of the computer 40. The processing unit 42 typically includes one or more processors, each of which may be in the form of any one of various commercially available processors. The system memory 44 typically includes a read only memory (ROM) that stores a basic input/output system (BIOS) that contains start-up routines for the computer 40 and a random access memory (RAM). The system bus 46 may be a memory bus, a peripheral bus or a local bus, and may be compatible with any of a variety of bus protocols, including PCI, VESA, Microchannel, ISA, and EISA. The computer 40 also includes a persistent storage memory 48 (e.g., a hard drive, a floppy drive, a CD ROM drive, magnetic tape drives, flash memory devices, and digital video disks) that is connected to the system bus 46 and contains one or more computer-readable media disks that provide non-volatile or persistent storage for data, data structures and computer-executable instructions.

A user may interact (e.g., enter commands or data) with the computer 40 using one or more input devices 50 (e.g., a keyboard, a computer mouse, a microphone, joystick, and touch pad). Information may be presented through a graphical user interface (GUI) that is displayed to the user on a display monitor 52, which is controlled by a display controller 54. The computer 40 also typically includes peripheral output devices, such as speakers and a printer. One or more remote computers may be connected to the computer 40 through a network interface card (NIC) 56.

As shown in FIG. 4, the system memory 44 also stores the audio processing system 10, a GUI driver 58, and a database 59 containing the audio signal 16, the classification output 18, and other data structures. In some embodiments, the audio processing system 10 interfaces with the GUI driver 58 and the user input 50 to control the creation of the classification output 18. In some embodiments, the computer 40 additionally includes an audio player that is configured to render the audio signal 16. The audio processing system 10 also interfaces with the GUI driver 58 and the classification output 18 and other data structures to control the presentation of the classification output 18 to the user on the display monitor 42.

B. Exemplary Embodiments of the Audio Parameter Data Processing Component

1. Estimating Pitch Values

In general, the audio parameter data processing component 12 may estimate the pitch values 20 in any of a wide variety of different ways (see FIG. 2, block 22).

In some exemplary embodiments, the audio parameter data processing component 12 calculates a respective pitch value for each frame in a series of overlapping frames (commonly referred to as "analysis frames") based on application of the short-time autocorrelation function in one or both of the time domain and the spectral domain. In some of these embodiments, the pitch values are estimated for each of the frames based on the following autocorrelation function $R(\tau)$, which corresponds to the weighted combination of the time-domain autocorrelation $R^T(\tau)$ and the spectral domain autocorrelation $R^S(\tau)$:

$$R(\tau)=\beta\cdot R^T(\tau)+(1-\beta)\cdot R^S(\tau) \tag{1}$$

The estimated pitch values are the values of the candidate pitch $\tau$ that maximize $R(\tau)$ for the respective frames. The parameter $\beta$ is a weighting factor that has a value between 0 and 1, and $R^T(\tau)$ and $R^S(\tau)$ are defined in equations (2) and (3).

$$R^T(\tau)=\frac{\sum_{n=0}^{N-\tau-1}[\tilde{s}_t(n)\cdot\tilde{s}_t(n+\tau)]}{\sqrt{\sum_{n=0}^{N-\tau-1}[\tilde{s}_t^2(n)\cdot\tilde{s}_t^2(n+\tau)]}} \tag{2}$$

$$R^S(\tau)=\frac{\int_0^{\tau-\omega_\tau}\tilde{S}_f(\omega)\cdot\tilde{S}_f(\omega+\omega_\tau)\cdot d\omega}{\sqrt{\int_0^{\tau-\omega_\tau}\tilde{S}_f^2(\omega)\cdot\tilde{S}_f^2(\omega+\omega_\tau)\cdot d\omega}} \tag{3}$$

where $\tilde{s}_t(n)$ is the zero-mean version of the audio signal $s_t(n)$, N is the number of samples, $\omega_\tau=2\pi/\tau$, $S_f(\omega)$ is the magnitude spectrum of the audio signal $s_t(n)$, and $\tilde{S}_f(\omega)$ is the zero-mean version of the magnitude spectrum $S_f(\omega)$. In some exemplary embodiments the weighting factor $\beta$ is equal to 0.5.

2. Determining Levels of Harmonic Content in the Candidate Harmonic Segments

In general, the audio parameter data processing component 12 may model the harmonic content in the audio signal 16 in any of a wide variety of different ways (see FIG. 2, block 26).

In some embodiments, the audio parameter data processing component 12 determines the respective levels of harmonic content in the candidate harmonic segments by computing the harmonic coefficient $H_a$ for each of the frames, where $H_a$ is the maximum value of the autocorrelation function $R(\tau)$ defined in equation (1). That is, $$H_a = \max_{\tau} R(\tau) \tag{4}$$

Note that the candidate pitch value $\tau$ that maximizes $R(\tau)$ for a given frame is the pitch value estimate for the given frame.

C. Exemplary Embodiments of the Classification Data Processing Component

1. Identifying Candidate Harmonic Segments in the Audio Signal

In general, the classification data processing component 14 may identify the candidate harmonic segments of the audio signal from the estimated pitch values in a wide variety of different ways (see FIG. 2, block 24). In some embodiments, the classification data processing component 14 identifies the candidate harmonic segments by identifying segments of the audio signal having slowly changing pitch amplitudes over a minimal duration. In general, the classification data processing component may identify such segments of the audio signal 16 in any of a wide variety of different ways.

In some embodiments, the classification data processing component 14 identifies the candidate harmonic segments based on a candidate segment predicate that defines at least one condition on the estimated pitch values 20. The candidate segment predicate specifies a range of difference values that must be met by differences between successive pitch values of the identified harmonic segments. The candidate segment predicate also specifies a threshold duration that must be met by the identified candidate harmonic segments. An exemplary candidate segment predicate in accordance with these embodiments is given by equation (5):

$$|\tau_p(k+i)-\tau_p(k+i+1)| \leqq \Delta_\tau \forall i=[0,m]$$

and $$m>T \tag{5}$$

In equation (5), $\tau_p(k)$ is the estimated pitch for the starting frame k of a given segment of the audio signal 16, $\Delta_\tau$ is an empirically determined difference threshold value, and T is an empirically determined duration threshold value.

2. Generating Classification Records for the Candidate Harmonic Segments

As explained above, the classification data processing component 14 generates an associated classification record for each of the candidate harmonic segments based on a harmonic content predicate defining at least one condition on the harmonic content levels (see FIG. 2, block 28). In some embodiments, the classification data processing component 14 identifies segments of the audio signal 16 corresponding to ones of the candidate harmonic segments having harmonic content levels satisfying the harmonic content predicate. The classification data processing component 14 associates the identified segments with respective classification records that include an assignment to a harmonic segment class.

The harmonic content predicate typically maps the candidate harmonic segments having relatively high levels of harmonic content to a harmonic segment class and maps other candidate harmonic segments having relatively low levels of harmonic content to a non-harmonic (e.g., noise) segment class.

In some embodiments, the harmonic content predicate specifies a first threshold, and the segments of the audio signal 16 corresponding to ones of the candidate harmonic segments having harmonic content levels that meet the first threshold are associated with respective classification records that include the assignment to the harmonic segment class. In some embodiments in which the harmonic content levels are measured by the harmonic coefficient defined in equation (4), the harmonic content predicate for classifying the candidate harmonic segments is given by equation (6):

$$\text{If } M_1(H_{a,i}(j)) \geqq H_1 \forall j \epsilon \{\text{segment}_i\}$$

$$\text{Then Class=Harmonic} \tag{6}$$

where $H_{a,i}(j)$ is the value of the $j^{th}$ harmonic coefficient value of segment i, $M_1(H_{a,i}(j))$ is a function of the harmonic coefficient values of segment i, and $H_1$ is an empirically determined threshold value. In some embodiments, the function $M_1(H_{a,i}(j))$ corresponds to a maximum value operator that produces the maximum value of the harmonic coefficient values. In other embodiments, the function $M_1(H_{a,i}(j))$ computes the mean harmonic coefficient value ($\tilde{H}_{a,i}$) of the segment i. In these embodiments, a candidate harmonic segment i is classified into the harmonic segment class if the mean harmonic coefficient value ($\tilde{H}_{a,i}$) of the segment i is greater than or equal to the first threshold.

In some of these embodiments, the harmonic content predicate additionally specifies a second threshold, and the segments of the audio signal corresponding to ones of the candidate harmonic segments having harmonic content levels between the first and second thresholds are associated with respective classification records that include confidence scores indicative of harmonic content levels in the associated segments of the audio signal 16. In some embodiments in which the harmonic content levels are measured by the harmonic coefficient defined in equation (4), the additional specification of the harmonic content predicate for classifying the candidate harmonic segments is given by equation (7):

$$\text{If } H_2 \geqq M_2(H_{a,i}(j)) \geqq H_1 \forall j \epsilon \{\text{segment}_i\}$$

$$\text{Then Class=Harmonic and Score}=S(H_{a,i}(j)) \tag{7}$$

where $H_2$ is an empirically determined threshold value, $M_2(H_{a,i}(j))$ is a function of the harmonic coefficient values of segment i, and $S(H_{a,i}(j))$ is a scoring function that maps the harmonic coefficient values of segment i to a confidence score that represents the likelihood that segment i is indeed a harmonic segment that corresponds to at least one of music and speech. In some embodiments, the function $M_2(H_{a,i}(j))$ computes the mean harmonic coefficient value ($\tilde{H}_{a,i}$) of the segment i. In one exemplary embodiment, if the mean harmonic coefficient value ($\tilde{H}_{a,i}$) of segment i is between $H_1$ and $H_2$, then $S(H_{a,i}(j))$ is a linear function that maps $\tilde{H}_{a,i}$ to a score between 0 and 1 in accordance with equation (8):

$$\text{Score} = \frac{\tilde{H}_{a,i} - H_2}{H_1 - H_2} \tag{8}$$

A wide variety of different scoring functions also are possible.

In some embodiments, the harmonic content predicate additionally specifies that segments of the audio signal corresponding to ones of the candidate harmonic segments having harmonic content levels below the second threshold ($H_2$) are classified into the non-harmonic segment class. In some embodiments in which the harmonic content levels are measured by the harmonic coefficient defined in equation (4), the additional specification of the harmonic content predicate for classifying the candidate harmonic segments is given by equation (9):

$$\text{If } M_3(H_{a,i}(j)) < H_2 \forall j \in \{\text{segment}_i\}$$

$$\text{Then Class=Non-Harmonic} \tag{9}$$

In some embodiments, the function $M_3$ ($H_{a,i}$(j)) computes the mean harmonic coefficient value ($\tilde{H}_{a,i}$) of segment i.

In general, each of the functions $M_1(H_{a,i}(j))$, $M_2(H_{a,i}(j))$, and $M_3$ ($H_{a,i}$(j)) may be any mathematical function or operator that maps the harmonic coefficient values to a resultant value.

IV. EXEMPLARY CLASSIFICATION RESULTS GENERATED BY EMBODIMENTS OF THE AUDIO PROCESSING SYSTEM

The results of applying an exemplary embodiment of the audio processing system 10 to audio signals containing different kinds of audio content are presented below. These audio signals are represented graphically by respective spectrograms, which show two-dimensional representations of audio intensity, in different frequency bands, over time. In each of these examples, time is plotted on the horizontal axis, frequency is plotted on the vertical axis, and the color intensity is proportional to audio energy content (i.e., light colors represent higher energies and dark colors represent lower energies). For each of the exemplary audio signals described below, the audio processing system 10 estimates frame pitch values in accordance with equations (1)-(3) and determines the frame harmonic coefficient values in accordance with equation (4).

A. Classifying Speech Signals with Low Levels of Background Noise

Figure 5A:
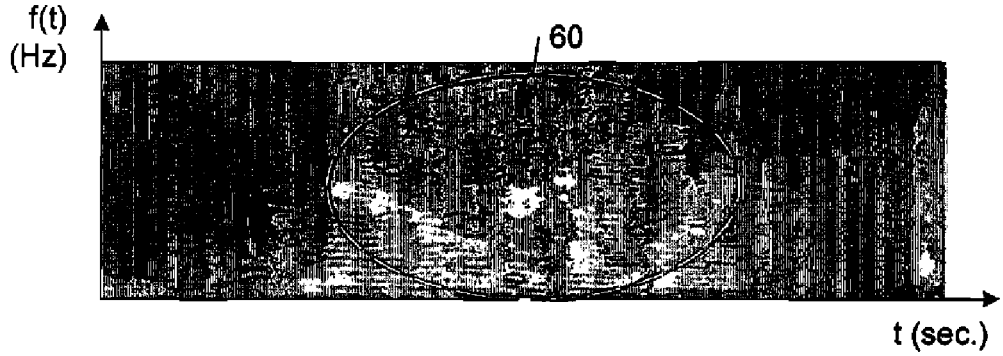
FIG. 5A is a spectrogram of a first audio signal showing a two-dimensional representation of audio intensity, in different frequency bands, over time.

FIG. 5A shows a spectrogram of a first audio signal that contains speech signals mixed with relatively low levels of background noise. The portion of the audio signal demarcated by the dashed oval 60 corresponds to the speech signal, which is evidenced by the presence of harmonic partials.

Figure 5B:
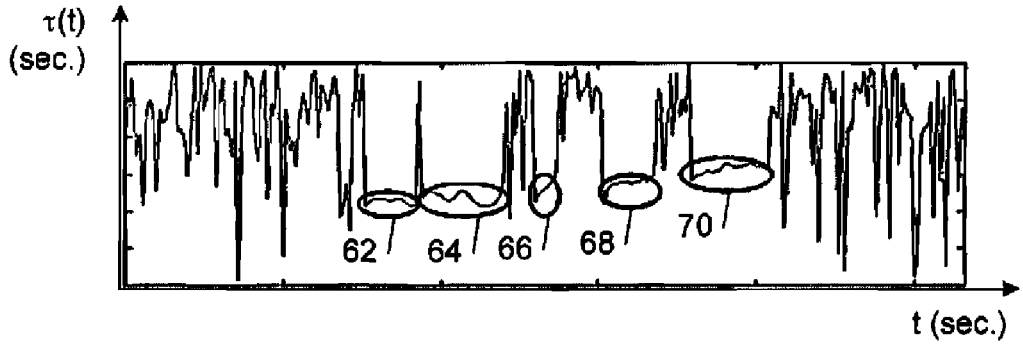
FIG. 5B is a graph of pitch values calculated from the first audio signal and plotted as a function of time.

FIG. 5B shows a graph of pitch values that are estimated from the first audio signal and plotted as a function of time. The pitch curve segments 62, 64, 66, 68, and 70 correspond to candidate harmonic segments that the exemplary embodiment of the audio processing system 10 has identified based on detection of those segments containing slowly changing amplitude variations over a minimal duration in accordance with equation (5). The pitch curve segments 62-70 have continuously changing pitch values (i.e., with small differences between neighboring points), which correspond to voiced components of the speech signal. In contrast, the noise portions of the pitch curve have much greater amplitude variations over time. In this example, the pitch values of the voiced speech components are mostly between 60 and 80. This pitch range corresponds to a frequency range of 100 Hz to 130 Hz at sampling rate of 8000 Hz, which is within the typical frequency range of the male voice (i.e., 100-150 Hz).

Figure 5C:
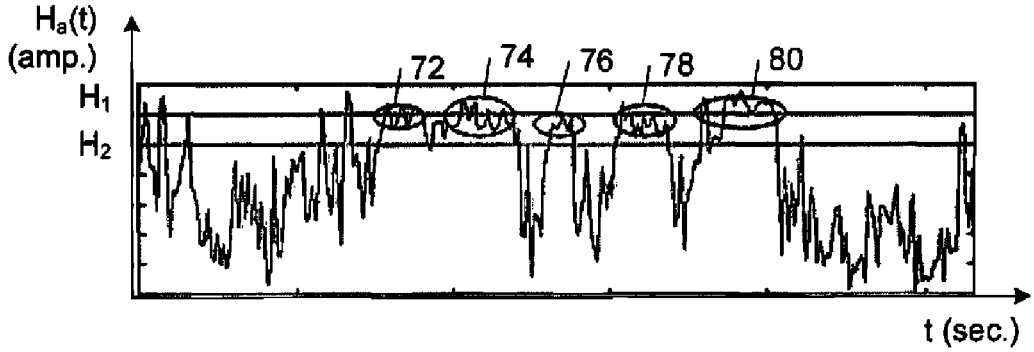
FIG. 5C is a graph of harmonic coefficient values calculated from the first audio signal and plotted as a function of time.

FIG. 5C shows a graph of harmonic coefficient values calculated from the first audio signal and plotted as a function of time. The harmonic coefficient curve segments 72, 74, 76, 78, 80 correspond to the pitch curve segments 62-70, respectively. The harmonic coefficient curve segments corresponding to the voiced speech segments generally have higher coefficient values (around 0.8) than the average coefficient values of the noise segments. The thresholds $H_1$ and $H_2$ are the empirically determined thresholds in equations (6)-(9). In the example shown in FIG. 5C, each of the harmonic coefficient curve segments 72-80 contains at least one harmonic coefficient value that is at least equal to the first threshold. Consequently, the audio signal segments corresponding to these candidate harmonic segments are assigned to the harmonic segment class in accordance with equation (6).

B. Classifying Speech Signals with Moderate Levels of Background Noise

Figure 6A:
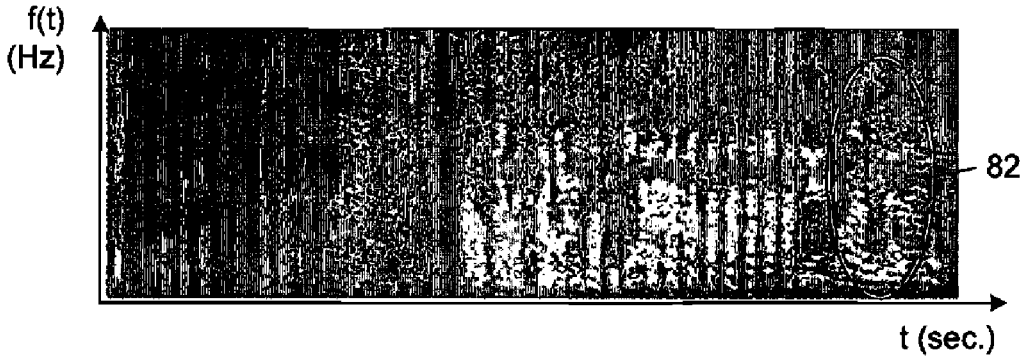
FIG. 6A is a spectrogram of a second audio signal showing a two-dimensional representation of audio intensity, in different frequency bands, over time.

FIG. 6A shows a spectrogram of a second audio signal that contains speech signals mixed with moderate levels of background noise. The portion of the audio signal demarcated by the dashed oval 82 corresponds to some voiced components of one sentence in the speech signal.

Figure 6B:
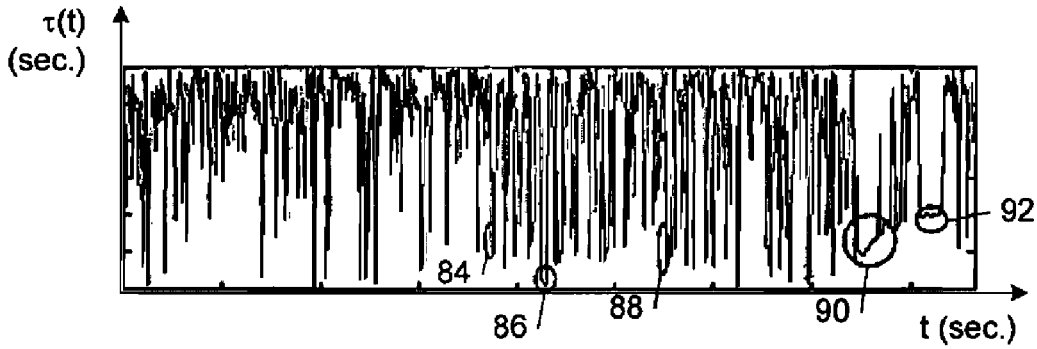
FIG. 6B is a graph of pitch values calculated from the second audio signal and plotted as a function of time.

FIG. 6B shows a graph of pitch values that are estimated from the second audio signal and plotted as a function of time. The pitch curve segments 84, 86, 88, 90, and 92 correspond to candidate harmonic segments that the exemplary embodiment of the audio processing system 10 has identified based on detection of those segments containing slowly changing amplitude variations over a minimal duration in accordance with equation (5). The pitch curve segments 84-92 have continuously changing pitch values (i.e., with small differences between neighboring points), which correspond to voiced components of the speech signal. In contrast, the noise portions of the pitch curve have much greater amplitude variations over time. In this example, the pitch values of the voiced speech components are mostly between 60 and 80. This pitch range corresponds to a frequency range of 100 Hz to 130 Hz at sampling rate of 8000 Hz, which is within the typical frequency range of the male voice (i.e., 100-150 Hz).

Figure 6C:
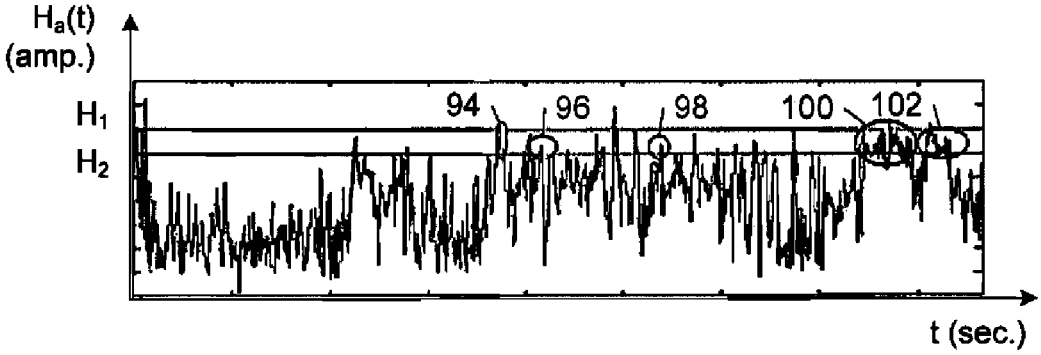
FIG. 6C is a graph of harmonic coefficient values calculated from the second audio signal and plotted as a function of time.

FIG. 6C shows a graph of harmonic coefficient values calculated from the second audio signal and plotted as a function of time. The harmonic coefficient curve segments 94, 96, 98, 100, 102 correspond to the pitch curve segments 84-92, respectively. The harmonic coefficient curve segments corresponding to the voiced speech segments generally have higher coefficient values (around 0.7-0.8) than the average coefficient values of the noise segments. The thresholds $H_1$ and $H_2$ are the empirically determined thresholds in equations (6)-(9). In the example shown in FIG. 6C, each of the harmonic coefficient curve segments 94, 100, and 102 contains at least one harmonic coefficient value that is at least equal to the first threshold. Consequently, the audio signal segments corresponding to the candidate harmonic coefficient curve segments 94, 100, and 102 are assigned to the harmonic segment class in accordance with equation (6). The remaining harmonic coefficient curve segments 96 and 98 have average coefficient values between $H_1$ and $H_2$ and, therefore, the audio signal segments corresponding to these harmonic coefficient curve segments are classified into the harmonic segment class and assigned a confidence score in accordance with equation (7).

C. Classifying Speech Signals with High Levels of Background Noise

Figure 7A:
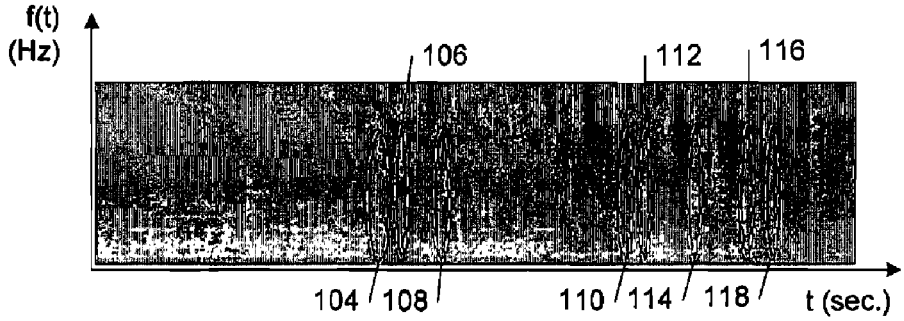
FIG. 7A is a spectrogram of a third audio signal showing a two-dimensional representation of audio intensity, in different frequency bands, over time.

FIG. 7A shows a spectrogram of a third audio signal that contains speech signals mixed with high levels of background noise. The portion of the audio signal demarcated by the dashed ovals 104, 106, 108, 110, 112, 114, 116, and 118 corresponds to eight segments of speech, where each segment contains a phrase or word that lasts about 0.5-1.5 seconds. The third audio signal was recorded in a casino, with high-level noise in the background (e.g., from the crowd, slot machines, the fountain, etc.), as evidenced by the light colored components across the frequency bands in the spectrogram.

Figure 7B:
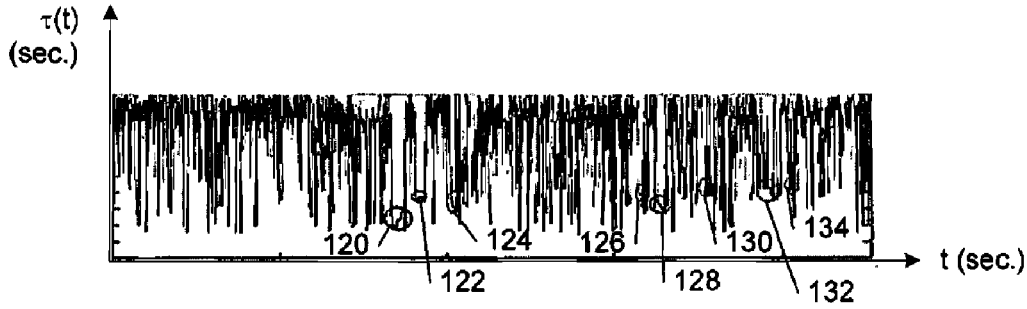
FIG. 7B is a graph of pitch values calculated from the third audio signal and plotted as a function of time.

FIG. 7B shows a graph of pitch values that are estimated from the third audio signal and plotted as a function of time. The pitch curve segments 120, 122, 124, 126, 128, 130, 132, and 134 correspond to candidate harmonic segments that the exemplary embodiment of the audio processing system 10 has identified based on detection of those segments containing slowly changing amplitude variations over a minimal duration in accordance with equation (5). The pitch curve segments 120-134 have continuously changing pitch values (i.e., with small differences between neighboring points), which correspond to voiced components of the speech signal. In contrast, the noise portions of the pitch curve have much greater amplitude variations over time. In this example, the pitch values computed for the speech segments 104-118 are mostly between 60 and 80. This pitch range corresponds to a frequency range of 100 Hz to 130 Hz at sampling rate of 8000 Hz, which is within the typical frequency range of the male voice (i.e., 100-150 Hz).

Figure 7C:
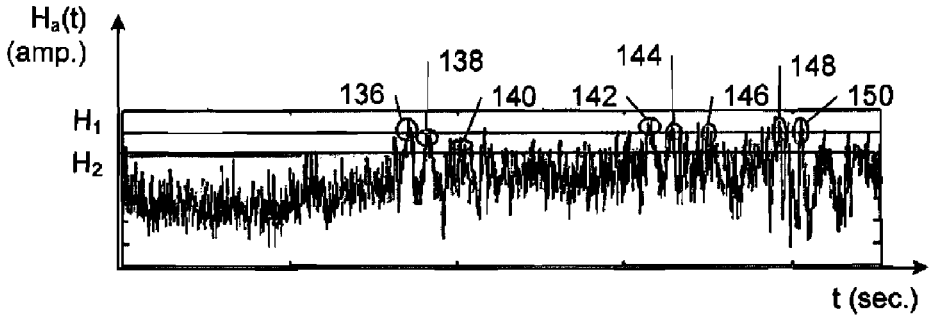
FIG. 7C is a graph of harmonic coefficient values calculated from the third audio signal and plotted as a function of time.

FIG. 7C shows a graph of harmonic coefficient values calculated from the third audio signal and plotted as a function of time. The harmonic coefficient curve segments 136, 138, 140, 142, 144, 146, 148, 150 correspond to the pitch curve segments 120-134, respectively. The harmonic coefficient curve segments corresponding to the voiced speech segments generally have higher coefficient values (around 0.8) than the average coefficient values of the noise segments. The thresholds $H_1$ and $H_2$ are the empirically determined thresholds in equations (6)-(9). In the example shown in FIG. 7C, each of the harmonic coefficient curve segments 136, 138, and 142-150 contains at least one harmonic coefficient value that is at least equal to the first threshold. Consequently, the audio signal segments corresponding to the candidate harmonic segments 136, 138, and 142-150 are assigned to the harmonic segment class in accordance with equation (6). The only remaining harmonic coefficient curve segment 140 has an average coefficient value between $H_1$ and $H_2$ and, therefore, the audio signal segment corresponding to this harmonic coefficient curve segment is classified into the harmonic segment class and assigned a confidence score in accordance with equation (7).

D. Classifying Speech Signals with Very High Levels of Background Noise

Figure 8A:
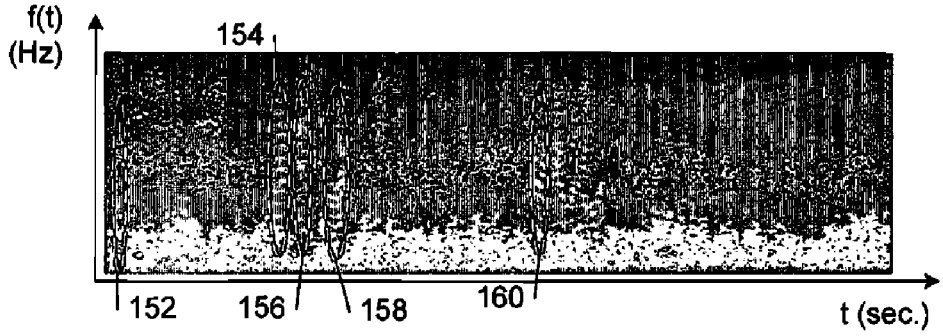
FIG. 8A is a spectrogram of a fourth audio signal showing a two-dimensional representation of audio intensity, in different frequency bands, over time.

FIG. 8A shows a spectrogram of a fourth audio signal that contains speech signals mixed with very high levels of background noise. The portion of the audio signal demarcated by the dashed ovals 152, 154, 156, 158, and 160 correspond to five segments of speech. The fourth audio signal corresponds to the audio track of a video recording of a bicycle riding with very loud wind noise in the background, as evidenced by the light colored components at the lower frequencies of the spectrogram.

Figure 8B:
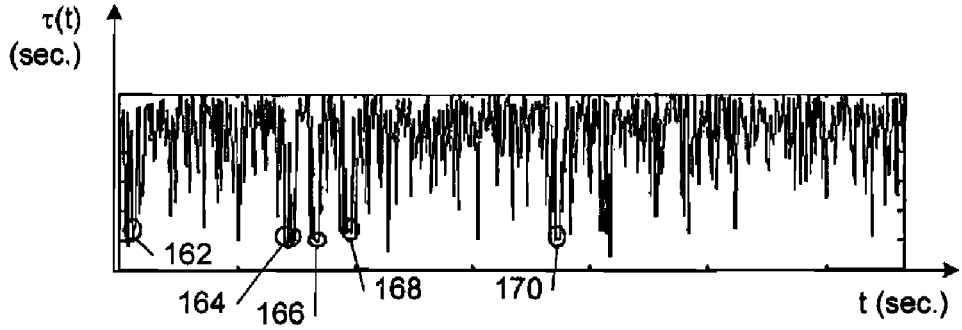
FIG. 8B is a graph of pitch values calculated from the fourth audio signal and plotted as a function of time.

FIG. 8B shows a graph of pitch values that are estimated from the fourth audio signal and plotted as a function of time. The pitch curve segments 162, 164, 166, 168, 170 correspond to candidate harmonic segments that the exemplary embodiment of the audio processing system 10 has identified based on detection of those segments containing slowly changing amplitude variations over a minimal duration in accordance with equation (5). The pitch curve segments 162-170 have continuously changing pitch values (i.e., with small differences between neighboring points), which correspond to voiced components of the speech signal. In contrast, the noise portions of the pitch curve have much greater amplitude variations over time.

Figure 8C:
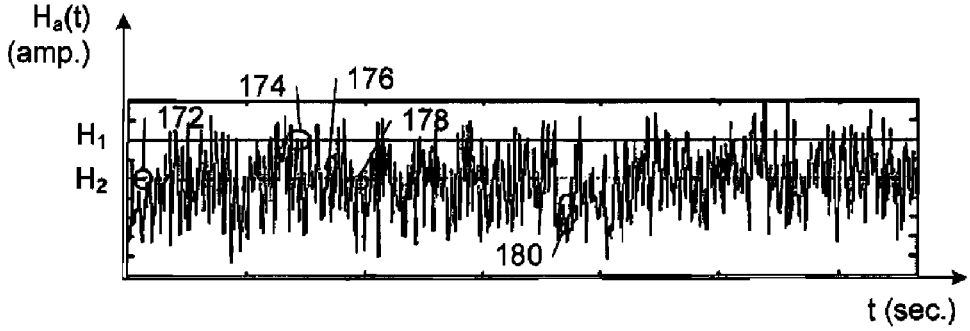
FIG. 8C is a graph of harmonic coefficient values calculated from the fourth audio signal and plotted as a function of time.

FIG. 8C shows a graph of harmonic coefficient values calculated from the fourth audio signal and plotted as a function of time. The harmonic coefficient curve segments 172, 174, 176, 178, and 180 correspond to the pitch curve segments 162-170, respectively. The harmonic coefficient curve segments corresponding to the speech segments 152-160 generally have higher coefficient values (around 0.7-0.8) than the average coefficient values of the noise segments. The thresholds $H_1$ and $H_2$ are the empirically determined thresholds in equations (6)-(9). In the example shown in FIG. 8C, the harmonic coefficient curve segment 174 contains at least one harmonic coefficient value that is at least equal to the first threshold and, therefore, the corresponding audio segment 154 would be assigned to the harmonic segment class in accordance with equation (6). The harmonic coefficient curve segments 172, 176 have average coefficient values between $H_1$ and $H_2$ and, therefore, the audio signal segments corresponding to these harmonic coefficient curve segments are classified into the harmonic segment class and assigned a confidence score in accordance with equation (7). The audio signal segments corresponding to the remaining harmonic coefficient curve segments 178 and 180 are classified into the non-harmonic segment class in accordance with equation (9).

E. Classifying Music Signals with Moderate Levels of Background Noise

Figure 9A:
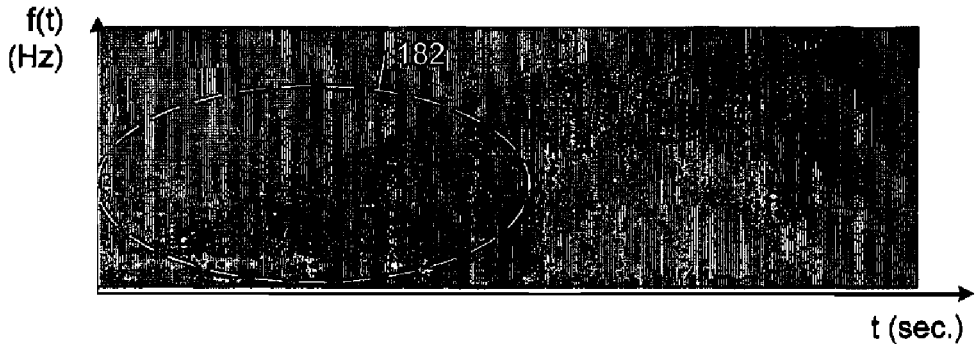
FIG. 9A is a spectrogram of a fifth audio signal showing a two-dimensional representation of audio intensity, in different frequency bands, over time.

FIG. 9A shows a spectrogram of a fifth audio signal that contains music signals mixed with moderate levels of background noise. The portion of the audio signal demarcated by the dashed oval 182 corresponds to piano sounds. The subsequent portion of the audio signal contains an applause followed by moderate-level ambient noise.

Figure 9B:
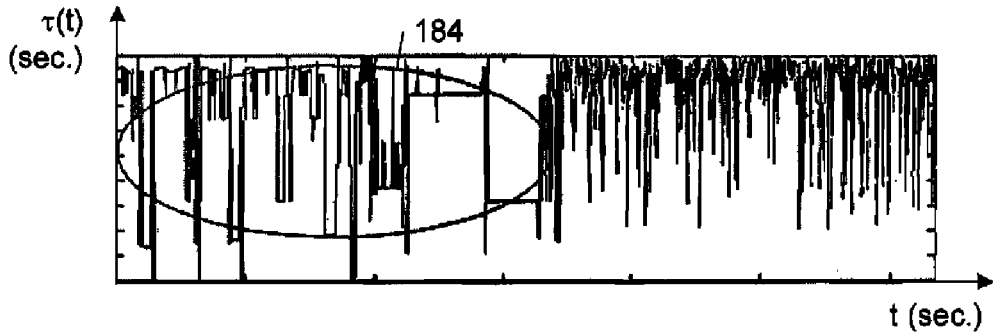
FIG. 9B is a graph of pitch values calculated from the fifth audio signal and plotted as a function of time.

FIG. 9B shows a graph of pitch values that are estimated from the fifth audio signal and plotted as a function of time. The pitch curve segments demarcated by the oval 184 correspond to the candidate harmonic segments that the exemplary embodiment of the audio processing system 10 has identified based on the detection of segments containing slowly changing amplitude variations over a minimal duration in accordance with equation (5). The identified pitch curve segments have continuously changing pitch values (i.e., with small differences between neighboring points), which correspond to components (typically individual notes) of the music signal. In contrast, the noise portions of the pitch curve have much greater amplitude variations over time.

Figure 9C:
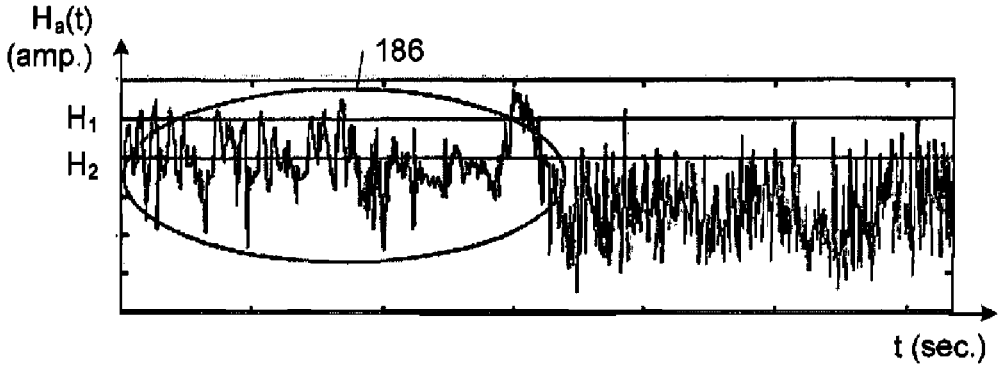
FIG. 9C is a graph of harmonic coefficient values calculated from the fifth audio signal and plotted as a function of time.

FIG. 9C shows a graph of harmonic coefficient values calculated from the fifth audio signal and plotted as a function of time. The harmonic coefficient curve segments demarcated by the oval 186 correspond to the pitch curve segments demarcated by the oval 184 in FIG. 9B. The harmonic coefficient curve segments corresponding to the music segments generally have higher coefficient values (around 0.7-0.8) than the average coefficient values of the noise segments. The thresholds $H_1$ and $H_2$ are the empirically determined thresholds in equations (6)-(9). In the example shown in FIG. 9C, each of the harmonic coefficient curve segments contains at least one harmonic coefficient value that is at least equal to the first threshold. Consequently, the audio signal segments corresponding to the candidate harmonic segments are assigned to the harmonic segment class in accordance with equation (6).

V. DISCRIMINATING SPEECH AND MUSIC SIGNALS IN HARMONIC AUDIO SEGMENTS

In some embodiments, the audio processing system 10 additionally is configured to assign each of the segments of the audio signal 16 that is assigned to the harmonic segment class (i.e., segments corresponding to ones of the candidate harmonic segments having harmonic content levels satisfying the harmonic content predicate) to one of a speech segment class and a music segment class based on a classification predicate that defines at least one condition on the estimated pitch values.

Figure 10:
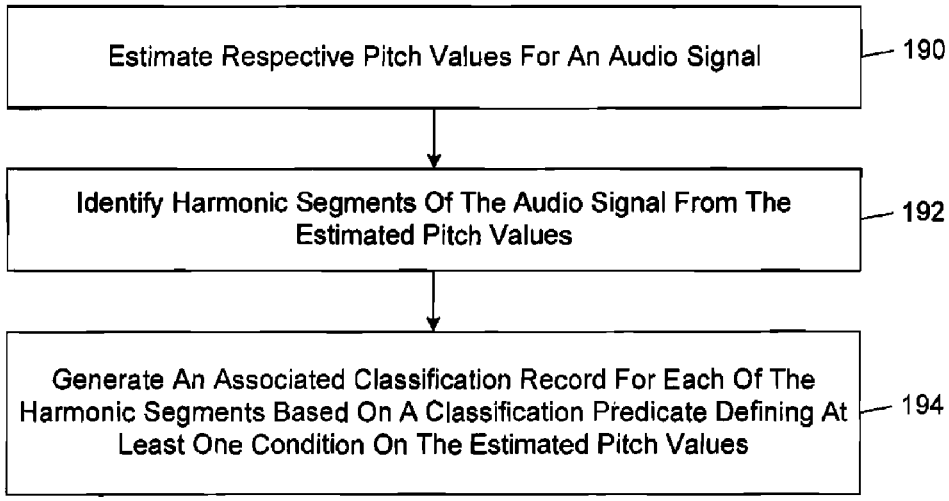
FIG. 10 is a flow diagram of an embodiment of an audio processing method.

FIG. 10 shows an embodiment of a method that is implemented by the audio processing system 10.

In accordance with this embodiment, the audio parameter data processing component 12 estimates respective pitch values for the audio signal (FIG. 10, block 190). The pitch values may be estimated in accordance with any of the pitch value estimation methods disclosed above (see, e.g., § IV.B.1).

The classification data processing component 14 identifies harmonic segments of the audio signal 16 from the estimated pitch values (FIG. 10, block 192). The harmonic segments (i.e., the segments of the audio signal 16 that are classified into the harmonic segment class) may be estimated in accordance with any of the harmonic segment classification methods disclosed above (see, e.g., § IV.C).

The classification data processing component 14 generates an associated classification record for each of the harmonic segments based on a classification predicate defining at least one condition on the estimated pitch values (FIG. 10, block 194). The classification records that are associated with ones of the harmonic segments that satisfy the classification predicate include an assignment to a speech segment class. The classification records that are associated with ones of the harmonic segments that fail to satisfy the classification predicate include an assignment to a music segment class. In general, the classification records may be generated and embodied in the classification output 18 in an analogous way as the classification records disclosed above.

In some embodiments, the classification predicate specifies a speech range of pitch values. For example, in some embodiments, the classification predicate classifies a given harmonic segment i into the speech segment class if all of its pitch values ($\tau_{p,i}$) are within an empirically determined speech pitch range [$P_2$, $P_1$] and have a variability measure (e.g., variance) value that is greater than an empirically determined variability threshold.

In some embodiments, the classification predicate is defined in accordance with equation (10):

$$\text{If } P2 \leqq \tau_{p,i,j} \leqq P_1 \forall j \text{ in segment i}$$

$$\text{and}$$

$$V(\tau_{p,i,j}) > V_{TH}$$

$$\text{Then Class=Speech} \tag{10}$$

where $V(\tau_{p,i,j})$ is a function that measures the variability of the pitch values in segment i and $V_{TH}$ is the empirically determined variability threshold. In these embodiments, the classification data processing component 14 associates ones of the harmonic segments having pitch values that satisfy the classification predicate with respective classification records that include an assignment to the speech segment class. The classification data processing component 14 associates ones of the harmonic segments having pitch values that fail to satisfy the classification predicate with respective classification records that include an assignment to the music segment class.

VI. CONCLUSION

The embodiments that are described in detail herein are capable of noise-resistant detection of speech and music in audio signals. These embodiments employ a two-stage approach for distinguishing speech and music from background noise. In the first stage, candidate harmonic segments, which are likely to contain speech, music, or a combination of speech and music, are identified based on an analysis of pitch values that are estimated for an audio signal. In the second stage, the candidate harmonic segments are classified based on an analysis of the levels of harmonic content in the candidate harmonic segments. Some embodiments classify the candidate harmonic segments into one of a harmonic segment class and a noise class. Some embodiments additionally classify the audio segments that are segmented into the harmonic segment class into one of a speech segment class and a music segment class based on an analysis of the pitch values estimated for these segments.

Other embodiments are within the scope of the claims.

What is claimed is:

1. A method, comprising:

estimating respective pitch values for an audio signal;

identifying candidate harmonic segments of the audio signal from the estimated pitch values;

determining respective levels of harmonic content in the candidate harmonic segments; and generating an associated classification record for each of the candidate harmonic segments based on a harmonic content predicate defining at least one condition on the harmonic content levels.

2. The method of claim 1, wherein the estimating comprises computing weighted combinations of time-domain autocorrelation and spectral-domain autocorrelation for frames of the audio signal, and determining pitch values that maximize the weighted combinations.

3. The method of claim 1, wherein the identifying comprises identifying the candidate harmonic segments based on a candidate segment predicate defining at least one condition on the estimated pitch values.

4. The method of claim 3, wherein the candidate segment predicate specifies a range of difference values that must be met by differences between successive pitch values of the identified candidate harmonic segments.

5. The method of claim 4, wherein the candidate segment predicate specifies a threshold duration that must be met by the identified candidate harmonic segments.

6. The method of claim 1, wherein the determining comprises computing weighted combinations of time-domain autocorrelation and spectral-domain autocorrelation for frames of the audio signal, and determining maximum values of the weighted combinations.

7. The method of claim 1, wherein the generating comprises associating ones of the candidate harmonic segments having harmonic content levels satisfying the harmonic content predicate with respective classification records comprising an assignment to a harmonic segment class.

8. The method of claim 7, wherein the harmonic content predicate specifies a first threshold, and the generating comprises associating ones of the candidate harmonic segments having harmonic content levels that meet the first threshold with respective classification records comprising the assignment to the harmonic segment class.

9. The method of claim 8, wherein the harmonic content predicate additionally specifies a second threshold, and the generating comprises associating ones of the candidate harmonic segments having harmonic content levels between the first and second thresholds with respective classification records comprising confidence scores indicative of harmonic content levels in the associated segments of the audio signal.

10. The method of claim 7, further comprising assigning each of the candidate harmonic segments having harmonic content levels satisfying the harmonic content predicate to one of a speech segment class and a music segment class based on a classification predicate defining at least one condition on the estimated pitch values.

11. A system, comprising:

an audio parameter data processing component operable to estimate respective pitch values for an audio signal and to determine respective levels of harmonic content in the audio signal; and a classification data processing component operable to identify candidate harmonic segments of the audio signal from the estimated pitch values and to generate an associated classification record for each of the candidate harmonic segments based on a harmonic content predicate defining at least one condition on the harmonic content levels.

12. The system of claim 11, wherein the classification data processing component is operable to identify the candidate harmonic segments based on a candidate segment predicate defining at least one condition on the estimated pitch values.

13. The system of claim 12, wherein the candidate segment predicate specifies a range of difference values that must be met by differences between successive pitch values of the identified candidate harmonic segments and specifies a threshold duration that must by met by the identified candidate harmonic segments.

14. The system of claim 11, wherein the audio parameter data processing component is operable to compute weighted combinations of time-domain autocorrelation and spectral-domain autocorrelation for frames of the audio signal, and the audio parameter data processing component additionally is operable to determine maximum values of the weighted combinations.

15. The system of claim 11, wherein the classification data processing component is operable to associate ones of the candidate harmonic segments having harmonic content levels satisfying the harmonic content predicate with respective classification records comprising an assignment to a harmonic segment class.

16. The system of claim 15, wherein the harmonic content predicate specifies a first threshold, and the classification data processing component is operable to associate ones of the candidate harmonic segments having harmonic content levels that meet the first threshold with respective classification records comprising the assignment to the harmonic segment class.

17. The system of claim 16, wherein the harmonic content predicate additionally specifies a second threshold, and the classification data processing component is operable to associate ones of the candidate harmonic segments having harmonic content levels between the first and second thresholds with respective classification records comprising a confidence score indicative of harmonic content levels in the associated segments of the audio signal.

18. The system of claim 15, wherein the classification data processing component additionally is operable to assign each of the candidate harmonic segments having harmonic content levels satisfying the harmonic content predicate to one of a speech segment class and a music segment class based on a classification predicate defining at least one condition on the estimated pitch values.

19. A method, comprising:

estimating respective pitch values for an audio signal;

identifying harmonic segments of the audio signal from the estimated pitch values; and generating an associated classification record for each of the harmonic segments based on a classification predicate defining at least one condition on the estimated pitch values, wherein classification records associated with ones of the harmonic segments satisfying the classification predicate comprise an assignment to a speech segment class and classification records associated with ones of the harmonic segments failing to satisfy the classification predicate comprise an assignment to a music segment class.

20. The method of claim 19, wherein the classification predicate specifies a speech range of pitch values, and the generating comprises associating ones of the harmonic segments having pitch values within the speech range and having a measure of variability value greater than a threshold variability value with respective classification records comprising an assignment to the speech segment class, and associating other ones of the harmonic segments with respective classification records comprising an assignment to the music segment class.

* * * * *

UNITED STATES PATENT AND TRADEMARK OFFICE

CERTIFICATE OF CORRECTION

PATENT NO. : 7,521,622 B1
APPLICATION NO. : 11/676174
DATED : April 21, 2009
INVENTOR(S) : Tong Zhang It is certified that error appears in the above-identified patent and that said Letters Patent is hereby corrected as shown below:

In column 15, line 39, in Claim 13, after "must" delete "by" and insert -- be --, therefor.

Signed and Sealed this

Twenty-fourth Day of November, 2009

David J. Kappos

David J. Kappos
*Director of the United States Patent and Trademark Office*